United States Patent [19]

Samejima et al.

[11] Patent Number: 4,643,808

[45] Date of Patent: Feb. 17, 1987

[54] METHOD FOR CONTROLLING CHLORATES

[75] Inventors: Yasushi Samejima, Kakogawa; Minoru Shiga, Himeji; Toshiji Kano; Takamichi Kishi, both of Kakogawa, all of Japan

[73] Assignee: Kanegafuchi Kagaku Kogyo Kabushiki Kaisha, Osaka, Japan

[21] Appl. No.: 657,545

[22] Filed: Oct. 4, 1984

[30] Foreign Application Priority Data

Oct. 4, 1983 [JP] Japan ..... 58-186255

[51] Int. Cl.[4] ..... C25B 1/16; C25B 1/34

[52] U.S. Cl. ..... 204/98; 204/128

[58] Field of Search ..... 204/95, 98, 128

[56] References Cited

U.S. PATENT DOCUMENTS

| | | | |
|---|---|---|---|
| 2,569,329 | 9/1951 | Osborne et al. | 204/98 |
| 2,610,105 | 9/1952 | Pye | 204/98 |
| 2,790,707 | 4/1957 | Johnson | 204/98 |
| 4,055,476 | 10/1977 | Benezra et al. | 204/98 |
| 4,272,338 | 6/1981 | Lynch et al. | 204/98 |
| 4,470,891 | 9/1984 | Moore et al. | 204/98 |
| 4,481,088 | 11/1984 | Moore et al. | 204/98 |
| 4,528,077 | 7/1985 | Fair et al. | 204/98 |

*Primary Examiner*—Terryence Chapman

*Attorney, Agent, or Firm*—Armstrong, Nikaido, Marmelstein & Kubovcik

[57] ABSTRACT

A method for controlling chlorates in an aqueous alkali metal hydroxide liquor produced by an ion exchange membrane electrolysis is provided, which comprises adding a reducing agent to brine to keep the concentration of chlorates to a specified value or less. The present invention provides an alkali metal hydroxide liquor with low content of chlorates.

2 Claims, 1 Drawing Figure

METHOD FOR CONTROLLING CHLORATES

BACKGROUND OF THE INVENTION

1. Field of the Invention

The present invention relates to electrolysis of an aqueous alkali metal halide solution using an ion exchange membrane, more specifically to a method for preventing an increase of chlorates contained in an alkali metal hydroxide liquor produced by said electrolysis.

2. Description of Prior Art

Recently, an alkali metal halide solution has been electrolysed on an industrial scale by so-called ion exchange membrane method. In such an ion exchange membrane method, it is general to circulate brine as in a mercury electrolysis method. That is, as shown by a schematic block diagram of FIG. 1, brine is adjusted in concentration and the like by a brine adjustment tank (1), then supplied into an anode compartment of a cell. Depleted brine after electrolysis is removed from the anode compartment (2), dissolved chlorine contained in the depleted brine is eliminated thoroughly by a dechlorination tank (3), then introduced to a salt dissolving tank (4) where crude brine is prepared. The crude brine is purified via a primary purification equipment (5) and a secondary purification equipment (6) to become a purified brine.

When ion exchange membrane electrolysis is continued according to the foregoing flow system, a phenomenon occurs that an amount of chlorates contained in catholyte increases. The increased chlorates in the catholyte (e.g., sodium hydroxide liquor) accelerates corrosion of materials of an evaporator, thereby resulting in an increase of impurities such as nickel, chromium and the like in a product. Moreover, some users of the product (e.g., caustic soda) may suffer from a disadvantage in unit consumption and troubles such as corrosion of materials of equipments and therefore the less the content of chlorates is, the better. In the case of caustic soda, the content of sodium chlorate is normally desired to be 10 ppm or less in a 50% NaOH solution.

SUMMARY OF THE INVENTION

It is therefore an object of the present invention to provide an ion exchange membrane electrolysis method for producing high quality aqueous alkali metal hydroxide liquor.

It is another object of the present invention to provide a method for controlling content of chlorates in an aqueous alkali metal hydroxide liquor.

These and other objects of the present invention together with the advantages thereof will become apparent to those skilled in the art from the detailed disclosure of the present invention as set forth hereinbelow.

According to the study made by the present inventors, it has been found out that the content of chlorates in the catholyte is varied depending on an amount of chlorate ion migrating through an ion exchange membrane from an anode compartment to a cathode compartment. The migrating amount of chlorate ion is influenced by electrolysis temperature, current density, concentration of an aqueous alkali metal hydroxide liquor (catholyte), concentration of an aqueous alkali metal halide solution (anolyte), concentration of chlorate in anolyte, pH value of anolyte, kind of an ion exchange membrane and the like. An extensive series of studies have been made by the present inventors on a method which is capable of repressing the content of chlorates most reliably and most economically, and the present invention has been completed on the discovery that an increase of chlorates in the product, an aqueous alkali metal hydroxide liquor, can be repressed by maintaining the concentration of chlorates to a specified value or less, paying attention to the phenomenon that the content of chlorates in the catholyte increases with an increase of chlorates contained in brine and decreases with a decrease thereof.

DETAILED DESCRIPTION OF THE INVENTION

Figure 1:
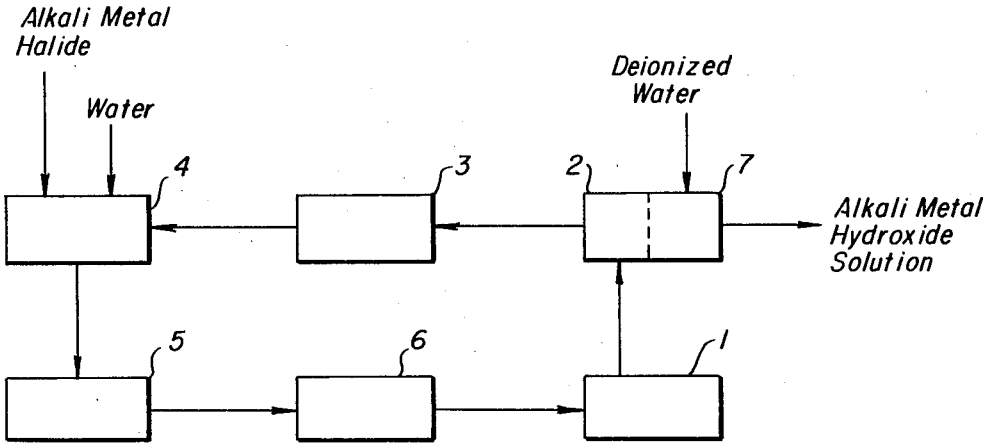
FIG. 1 is a schematic block diagram showing a flow system of an ion exchange membrane electrolytic process.

The present invention encompasses a control method of chlorates contained in an aqueous alkali metal hydroxide liquor which comprises adding a reducing agent to brine to maintain the concentration of chlorates to a specified value or less in electrolysis of an aqueous alkali metal halide solution by use of an ion exchange membrane.

It is well-known that in an anode compartment chlorate ion is generated electrochemically or chemically. The generation reactions are as below;

$$6ClO^- + 3H_2O \rightarrow 2ClO_3^- + 4Cl^- + 6H^+ + 3/2O_2 + 6e^- \quad (1)$$

$$ClO^- + 2HClO \rightarrow ClO_3^- + 2Cl^- + 2H^+ \quad (2)$$

$$3Cl_2 + 6OH^- \rightarrow ClO_3^- + 5Cl^- + 3H_2O \quad (3)$$

$$3Cl_2 + 3H_2O \rightarrow ClO_3^- + 6H^+ + 3H_2O \quad (4)$$

The equation (1) is an electrochemical reaction and the equations (2) to (4) are chemical reactions. The generation of chlorate ion according to the above reactions is repressed as a pH value of anolyte lowers. However, ion exchange membrane electrolysis is normally operated while keeping an anode in contact with an ion exchange membrane since a cathode compartment is pressurised in order to reduce cell voltage. When an anode is contacted with the membrane excessively, partial reaction takes place preferentially and an effect of repressing generation of chlorate ion resulting from a low pH value is difficult to be provided. Moreover, in an ion exchange membrane electrolysis on an industrial scale a plurality of cells are operated and those cells are normally variant in performance (current efficiency, in particular). In such a case, in cells with bad current efficiency, the pH value of anolyte becomes higher than that in the other cells and hence chlorates are produced in greater amounts. Furthermore, ion exchange membrane electrolysis generally employs metal anodes which are different in oxygen overvoltage depending on the kind of anode-coating materials and it is known that anodes with high oxygen overvoltage generate a greater amount of chlorates as compared with those with low oxygen overvoltage. In order to consider an amount of chlorates generated in a cell, a ratio at which hydroxyl ion that migrated into the anode compartment is converted to chlorate ion is represented by R. R is variable according to operating conditions and the like but is normally in a range between 1% and 30%. With brine to which hydrochloric acid was added, R is usually in a range of from 1 to 3%, whereas with brine to which no hydrochloric acid was added, R is in a range of 10 to 30%. When chlorates are neither discharged nor decomposed, in particular, during the course of operation of the ion exchange membrane cell, the concentration of chlorates in brine gradually increases. Brine discharged out of the system in the normal operation is only mother liquor entrained by brine and which is approximately 10 liters per ton of NaOH in the case of electrolysis of sodium chloride. That is, the concentration of chlorates in the brine increases until an amount of chlorates removed out of the system as the mother liquor entrained by brine mud becomes equal to that of chlorates generated in the system. Incidentally, R and an equilibrium concentration of chlorates in the brine at current efficiency of 95% are provided as below;

| R (%) | Equilibrium concentration (g/l) of sodium chlorates in the brine |
|---|---|
| 1 | 15 |
| 2 | 30 |
| 3 | 45 |
| 10 | 152 |
| 20 | 303 |
| 30 | 455 |

On the other hand, in order to control the content of sodium chlorate in catholyte to 10 ppm or less in a 50% NaOH solution in the electrolysis of sodium chloride, the concentration of sodium chlorate in the brine should preferably be controlled to 10 g/l or below, more preferably 5 g/l or below, especially 2 g/l or below, though dependent on electrolytic conditions and the kind of ion exchange membranes.

To maintain the content of chloric acid ion in the brine to not more than the specified value, a method for purging part of brine is considered but it is not advisable since loss of materials in a great amount is unavoidable. Another method is disclosed by Japanese Patent Non-examined Publication No. 28294/1979 in which hydrochloric acid is added to brine to thus decompose chlorates. This method, however, has a drawback that conversion is low unless the concentration of chlorates is high, and therefore it is not suited to such cases where the content of chlorates should be 10 g/l or below.

As a reducing agent usable in the present invention, any reducing agent may be employed, provided that not only is toxicity low, but reaction products obtained by reaction with chlorate ion place no adverse effects on ion exchange membrane electrolysis, or that products giving adverse effects a little, even when produced, are removable by prior-treatment of the brine and the like. Examples are sulfites, pyrosulfites, sulfurous acid gas etc., which react with chlorate ion to produce sulfates, hypophosphites, phosphites etc., which react with chlorate ion to produce phosphates, hydrochlorides or sulfates of hydroxylamine or the like. Of those substances, sulfites, pyrosulfites and sulfurous acid gas are preferred to use because of rapid reaction velocity with chlorate ion as well as cheapness. When these reducing agents are served, the reaction products are sulfate ions, which are removable by an ordinary desulfate.

The form of a salt of a reducing agent should preferably be an alkali metal identical to an alkali metal hydroxide, talking into consideration a product obtained. A reducing agent in a form of solid had better be added to the system as an aqueous solution and a reducing agent in a form of gas had better be blown in the brine or applied by use of a gas-liquid mixing means. An addition of an aqueous reducing agent solution may be attained by many methods. For example, one is to provide a chlorate-decomposing tank where part of brine is mixed and reacted with a reducing agent and another is to add a reducing agent directly to a brine-supply line of an ion exchange membrane electrolysis system. In the event that in the case of latter the reducing agent is added to a depleted brine line, it is economical to add it to the depleted brine which underwent dechlorination. It is possible to achieve effective use of a reducing agent and an increase in reaction velocity by controlling a pH of brine to a value peculiar to the reducing agent. When sulfites, pyrosulfites or sulfurous acid gas are used, a pH value should preferably be controlled to 3 or less, more preferably to a range of from 2 to 3. With a pH value more than 3, chlorates are hardly decompoed, while with a pH value less than 2, evolution and release of sulfurous acid gas are liable to take place, thereby leading to undesired results including such as environmental pollution and increased unit consumption unless special consideration such as installation of a sulfurous acid gas-absorbing device is taken.

An amount of a reducing agent added should preferably be not less than equivalent to chlorates produced within the system. When brine containing no free chlorine is reacted with a reducing agent in a closed system, loss of the reducing agent resulting from spattering and side reactions is small and hence an amount approximately equivalent to chlorates attains the purpose. In contrast, when brine containing part of free chlorine is subjected to reaction or reaction is allowed to take place in an open system, an addition of the reducing agent equivalent to chlorates generated is not sufficient. An amount of chlorates generated is calculated, for every cell, from the concentration of chlorates and the flow rate of brine supplied and depleted brine, and an average amount of chlorates of all cells is calculated from an increasing velocity in the concentration of chlorates in brine without adding a reducing agent and an amount of brine held in the whole system.

Hereinafter, the present invention will be described in more detail by way of examples dealing with electrolysis of sodium chloride, to which the invention is by no way limited. The present invention is of course applicable to the electrolysis of other alkali metal halides such as potassium chloride and the like.

EXAMPLE 1

A cation exchange membrane "NEOSEPTA-FC1000", manufactured by Tokuyama Soda Co., Ltd., was installed to a box type electrolytic cell, a metallic electrode was served as an anode and a perforated plate made of mild steel was served as a cathode. Electrolysis of sodium chloride was carried out while pressurizing a cathode compartment so as to bring the cation exchange membrane into contact with the anode. The cell was operated at 80° C. with electric current of 150 KA, current density of 23.5 A/dm$^2$, caustic soda concentration of 20% and sodium chloride concentration of anolyte of 200 g/l. As a result, current efficiency was 95% and cell voltage was 3.65 V. Sixty-six cells were operated and the total amount of brine held in the system being 1800 m$^3$. During the course of operation, an amount of hydrochloric acid added to the cells was varied to measure formation velocity of sodium chlorate. The obtained results were given below;

| | Amount of HCl added | $O_2/Cl_2$ (%) | R (%) | Increasing velocity of $NaClO_3$ conc. (mg/l · Hr) |
|---|---|---|---|---|
| No. 1 | 4% (to theoretical production amount of caustic soda) | 0.3 | 1 | 1.8 |
| No. 2 | 3% | 0.8 | 2 | 3.6 |
| No. 3 | No addition | 2.3 | 20 | 36.4 |

At the beginning of operation, the concentration of sodium chlorate in brine was zero while the content of sodium chlorate in catholyte was not more than 0.5 ppm in a 50% NaOH solution. Operation was continued while keeping an addition amount of hydrochloric acid to 4% to the theoretical production amount of caustic soda. After one-month operation, the concentration of sodium chlorate in brine increased up to 1.6 g/l and the content of sodium chlorate in catholyte went up to 5 ppm in a 50% NaOH solution, thereafter no change in an increasing tendency could be seen.

As the concentration of sodium chlorate, leaving it as it is, further goes up, a reducing agent was added to decompose sodium chlorate. As the reducing agent, an aqueous sodium sulfite solution containing $Na_2SO_3$ at the concentration of 100 g/l was added at a rate of 225 l/Hr to depleted brine (pH: 2.5, free chlorine: 50 mg/l or less) after dechlorination by a vacuum method. After the aqueous sodium sulfite solution was added, the brine contained neither free chlorine nor unreacted sodium sulfite and the decreasing of concentration of sodium chlorate between before and after addition was 40 mg/l. Sodium sulfite was added in an amount of 20% up from equivalent to sodium chlorate produced in the system, taking it into full consideration that some amount of sodium sulfite was consumed by free chlorine. After the addition of sodium sulfite, the concentration of sodium chlorate in brine was constant to a range of from 1.5 to 1.6 g/l while the content of sodium chlorate in catholyte was kept constant to a range of from 4 to 5 ppm in a 50% NaOH solution, and thus an increasing phenomenon of sodium chlorate could be prevented.

EXAMPLE 2

Operation was effected in a similar manner to that of Example 1 except that instead of sodium sulfite, an aqueous sodium pyrosulfite solution containing $Na_2S_2O_5$ at the concentration of 100 g/l was added at a rate of 170 l/Hr to depleted brine (pH: 2.5) after dechlorination by a vacuum method. No unreacted acid sulfite ion was remainded in brine after the aqueous sodium pyrosulfite solution being added, and the concentration of sodium chlorate contained in the brine was reduced by 40 mg/l between before and after addition. As a result of adding the reducing agent, sodium chlorate in the brine was made constant to a range from 1.5 to 1.6 g/l while the content of sodium chlorate in catholyte was maintained to a range of from 4 to 5 ppm in a 50% NaOH solution.

EXAMPLE 3

In the ion exchange membrane electrolysis in Example 1, concentrated brine before a primary purification (pH: 7.0, NaCl: 310 g/l) was taken out at a rate of 10 $m^3$/Hr and introduced to a gas-liquid mixing tank equipped with an agitator. Into the gas-liquid mixing tank was sulfurous acid gas ($SO_2$: 10 Vol. %) charged at a rate of 40 $m^3$/Hr and a resulting mixture was adjusted to a pH 2 to 3 by addition of a 25% caustic soda at a rate of 25 l/Hr. In the brine exiting from the gas-liquid mixing tank no ingredient of the reducing agent was contained and the concentration of sodium chlorate decreased by 0.5 g/l. The absorption efficiency of sulfurous acid gas was 99% or more and exhaust gas from the gas-liquid mixing tank was introduced to a chlorine gas scrubber where a small amount of sulfurous acid gas contained was perfectly removed.

The brine exiting from the gas-liquid mixing tank was transported to the next step, a desulfate tank where sulfate ion was eliminated, then introduced to a primary purification step to mix with brine of the whole system.

Through the continuation of the above procedures, the content of sodium chlorate contained in the brine supplied to the cell was made constant to a range of from 1.5 to 1.6 g/l whereas the content of sodium chlorate contained in catholyte was maintained to a range of from 4 to 5 ppm in a 50% NaOH solution.

COMPARATIVE EXAMPLE 1

To a cell having a working area of 4 cm × 10 cm, was a cation exchange membrane "NEOSEPTA-FC1000", manufactured by Tokuyama Soda Co., Ltd., installed. As an anode a metallic anode was served and as a cathode a perforated plate made of mild steel was served. The ion exchange membrane was positioned in such a manner that it was 1 mm apart from the anode and 2 mm apart from the cathode, respectively. Upon the side of the cathode, the pressure of +100 mm $H_2O$ was imposed to substantially bring the membrane into contact with the anode. Operation was continued at 80° C. with the caustic soda concentration 20%, sodium chloride concentration 200 g/l in anolyte and current density 23.5 A/d $m^2$. During the course of operation, the concentration of sodium chlorate in brine supplied was varied and the content of sodium chlorate in catholyte was measured. The results were set forth below. In the above test, hydrochloric acid was added in an amount corresponding to 4% of theoretical production amount of caustic soda.

| $NaClO_3$ concentration (g/l) in brine supplied | $NaClO_3$ content (ppm/50% NaOH) in catholyte |
|---|---|
| 0 | 0 |
| 2 | 6 |
| 5 | 15 |
| 10 | 30 |
| 20 | 80 |

The above results show that when the cation exchange membrane "NEOSEPTA-FC1000" was employed, the concentration of sodium chlorate in the brine had to be controlled by the present invention to 3.3 g/l or less in order to obtain catholyte whose content of sodium chlorate was 10 ppm or less in a 50% NaOH solution

COMPARATIVE EXAMPLE 2

To the same cell as used in Comparative Example 1, a cation exchange membrane "FLEMION 723", manufactured by Asahi Glass Co., Ltd., was installed. The operation conditions were similar to those of Comparative Example 1, except the caustic soda concentration being 35%. Under these conditions, the relationship between the sodium chlorate concentration in brine and the content of sodium chlorate in catholyte was as below;

| $NaClO_3$ concentration (g/l) in brine supplied | $NaClO_3$ content (ppm/50% NaOH) in catholyte |
|---|---|
| 0 | 0 |
| 2 | 1.5 |
| 5 | 3.8 |
| 10 | 9.0 |
| 20 | 25.0 |

It is apparent from the above results that to control the content of sodium chlorate in catholyte to 10 ppm or below in a 50% NaOH solution using the cation exchange membrane "FLEMION 723", the concentration of sodium chlorate contained in the brine should be reduced to 10.5 g/l or below according to the present invention.

What we claim is:

1. A method for controlling chlorates contained in an aqueous alkali metal hydroxide solution in the electrolysis of an aqueous alkali metal halide solution using an ion exchange membrane, which comprises carrying out electrolysis of an aqueous alkali metal halide solution using an ion exchange membrane to produce a depleted brine containing chlorates formed in the electrolysis, dechlorinating the depleted brine, and producing a dechlorinated brine having a pH of not more than three, adding a reducing agent to the dechlorinated brine to reduce the concentration of the chlorates, the amount of reducing agent added being not less than an equivalent of the chlorate produced during electrolysis, combining the brine having a reduced concentration of chlorates with other brine to produce a feed aqueous alkali metal halide solution having a concentration of chlorates of 10 g per liter or less and carrying out electrolysis of said feed aqueous alkali metal halide solution using an ion exchange membrane.

2. The method of claim 1, wherein the reducing agent is at least one member selected from the group consisting of sulfites, pyrosulfites and sulfurous acid gas.

* * * * *